United States Patent [19]

Williams

[11] 4,243,338

[45] Jan. 6, 1981

[54] WRITING INSTRUMENT AND HOLDER ASSEMBLY

[76] Inventor: James K. Williams, 7 Peasenhall La., Cincinnati, Ohio 45208

[21] Appl. No.: 943,661

[22] Filed: Sep. 18, 1978

[51] Int. Cl.[3] ..... B43K 29/00

[52] U.S. Cl. ..... 401/195; 40/334; 40/124.1

[58] Field of Search ..... 401/52, 195; 40/334, 40/10, 124.1

[56] References Cited

U.S. PATENT DOCUMENTS

| | | | |
|---|---|---|---|
| D. 164,548 | 9/1951 | Blish | 40/334 X |
| 354,800 | 12/1886 | McDonald | 401/52 |
| 2,248,145 | 7/1941 | Wilder | 40/334 |
| 3,846,927 | 11/1974 | Geffen | 40/334 |
| 3,961,852 | 6/1976 | Parry | 401/52 |

*Primary Examiner*—Louis G. Mancene
*Assistant Examiner*—Wenceslao J. Contreras

[57] ABSTRACT

A writing instrument comprising a ballpoint pen assembly, a holder for the assembly having two substantially flat surfaces in opposed parallel relation, the thickness of the holder ranging from about 1 to about 4 mm, the ballpoint pen assembly being accommodated in an elongated channel in the holder with a writing tip projecting outwardly therefrom, the flat surfaces having a width at least about ten times the thickness of the holder. The flat surfaces have indicia or the like thereon applied by imprinting one side only of an elongate web, folding thereof to envelop the holder and die-cutting into a desired configuration. The method of making the writing instrument includes imprinting one side only of an elongate web, severing the web into lengths twice that of the writing instrument, forming in the web an elongated channel suitable to accommodate a ballpoint pen assembly, folding the web to envelop the ballpoint pen assembly and leave the writing tip projecting from one end, adhering the folded web portions together, and die-cutting the adhered web portions into a desired configuration.

9 Claims, 6 Drawing Figures

WRITING INSTRUMENT AND HOLDER ASSEMBLY

BACKGROUND OF THE INVENTION (1) Field of the Invention

This invention relates to a writing instrument comprising a ballpoint pen assembly having a writing tip and an elongated cylindrical ink cartridge, and a holder for said assembly, which is so configured as to be carried conveniently in a wallet, check-book or the like, and which can incorporate advertising or other printed indicia on the writing instrument itself. The invention further provides a method of making such a writing instrument simply and inexpensively. Although not so limited, the writing instrument has particular utility in the display of a printed advertising message which is readily adapted to various types of distribution, such as binding or spot-gluing into magazines, mailing in ordinary envelopes with other printed matter, and display on a rack at conventional point-of-purchase locations.

(2) Description of the Prior Art

United States Design Pat. Nos. 195,924, issued Aug. 6, 1963 to R. Perlmutter, and 207,563 issued May 2, 1967 to F. O. Bailey, Jr., disclose, respectively, a ballpoint pen having a generally elliptical cross-section, and a ballpoint pen and keychain having a relatively flat cross-section. In the Perlmutter patent a ballpoint pen cartridge is enclosed between two pieces of relatively flat plastic which are seamed at their edges. In the Bailey patent a ballpoint pen cartridge having a retractable writing tip is enclosed in an undisclosed manner within a relatively flat holder having a perforation through which a keychain is engaged at the end remote from the writing tip.

U.S. Pat. No. 2,902,977, issued Sept. 8, 1959 to J. P. Shurcliff discloses a pencil having a holder with a relatively flat exterior face and a groove provided in the face. A shoulder is provided on one end of the holder with an opening therethrough aligned with the groove. A piece of writing lead is slidably mounted in the groove extending above the holder face and through the opening in the shoulder. A tape of flexible material having pressure-sensitive adhesive on one face thereof is positioned in covering adhering contact with the holder face and lead so as to retain the lead in position.

A pencil having a rhombic cross-section is disclosed in the U.S. Pat. No. 488,818 issued Dec. 27, 1892, while a holder for a conventional "carpenter's pencil" is disclosed in U.S. Pat. No. 1,873,614, issued Aug. 23, 1932.

To the best of applicant's knowledge, the prior art has not suggested a writing instrument having a ballpoint pen cartridge which is so shaped as to be conveniently carried in a wallet, check-book or pocket book and which at the same time can be economically fabricated in a variety of configurations with imprinted indicia on two flat surfaces thereof to convey an advertising message or the like.

SUMMARY OF THE INVENTION

It is a principle object of the present invention to provide a writing instrument comprising a ballpoint pen assembly having a writing tip and an elongated cylindrical ink cartridge, and a holder for the assembly having two substantially flat surfaces having indicia and the like imprinted thereon.

It is a further object of the invention to provide a method of making a writing instrument of the above-described type.

The present invention provides a writing instrument comprising a ballpoint pen assembly having a writing tip and an elongated cylindrical ink cartridge, a holder for the assembly having two substantially flat surfaces secured in opposed parallel relation, the thickness of the holder ranging from about 1 to about 4 mm, and an elongated channel in the holder enclosed by the flat surfaces in which the cartridge is secured with the writing tip projecting outwardly from the holder, the flat surfaces having a width at least about ten times the thickness of the holder and a length exceeding that of the pen assembly, both said flat surfaces having indicia and the like thereon applied by imprinting one side only of an elongate web, folding thereof to envelop the holder, and die-cutting into a desired configuration.

A method of making a writing instrument in accordance with the invention comprises the steps of imprinting one side only of an elongate web with indicia and the like, severing the web into lengths substantially twice that of the writing instrument, forming in the web an elongated channel of dimensions suitable to accommodate an elongated cylindrical ink cartridge, positioning the ink cartridge in the channel, folding the web to envelop the cartridge and leave the ballpoint writing tip projecting from one end, adhering the folded web portions together with the imprinted indicia on the outer surfaces, and die-cutting the adhered web portions into a desired configuration.

In one embodiment of a writing instrument in accordance with the invention, the holder is comprised of an elongate web of adhesive-backed paperboard, foamed resin, and the like, and the elongated channel in which the ink cartridge is secured is formed in the web by embossing.

In another embodiment the elongate web is adhesive-backed paper, foil, plastic film, and the like on which the indicia are imprinted, and the holder includes spaced-apart strips of paperboard, wood, foamed resin, and the like, having a thickness of about 1 to about 4 mm secured in parallel relation between the folded web, the elongated channel being provided between the spaced-apart strips, to provide reinforcement.

DESCRIPTION OF THE PREFERRED EMBODIMENTS

Figure 1:
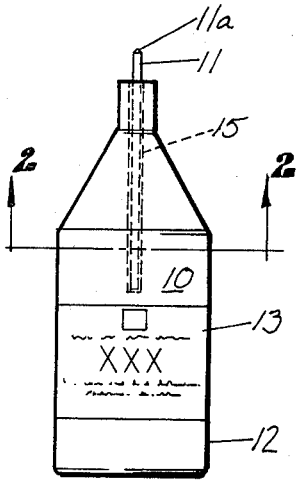
FIG. 1 is an elevational view of a writing instrument embodying the invention.

Referring to FIG. 1, a writing instrument is shown having the general configuration of a beverage bottle, comprising a holder indicated generally at 10 and a ballpoint pen assembly indicated at 11 having a writing tip 11*a*. The ballpoint pen assembly 11 is conventional and includes an elongated cylindrical ink cartridge.

Figure 2:
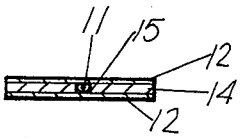
FIG. 2 is a sectional view taken on the line 2—2 of FIG. 1.

As shown in FIGS. 1 and 2 the holder comprises two substantially flat surfaces 12 on which indicia are imprinted as indicated at 13. In the case of a beverage bottle, this may simulate a printed label, or the like, or other imprinting pertinent to a product being advertised.

As shown in FIG. 2, in one embodiment of the invention the holder includes spaced-apart strips of paperboard, wood, foamed resin and the like, indicated at 14, secured between opposed web portions 12. The strips 14 are secured in parallel relation with a spacing therebetween sufficient to provide an elongated channel, indicated at 15, therebetween in which the cartridge 11 is positioned. For clarity of illustration, the thickness of elements 12 and 14 is exaggerated in FIG. 2, but it will be understood that the width of the flat surfaces, at least over a predominant area of the holder, will be at least about ten times the thickness of the holder, and the length of the holder substantially exceeds that of the ink cartridge, as shown in FIG. 1.

Figure 5:
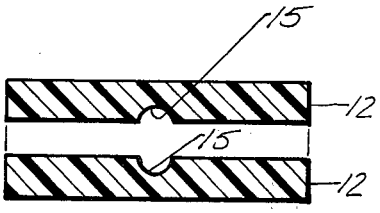
FIG. 5 is a sectional view of one embodiment of a holder in accordance with the invention.

Referring next to FIG. 5, another embodiment of the holder is shown wherein the elongate web 12 is paperboard, foamed resin, or the like, having a thickness of about ½ to about 2 mm, and in which a channel 15 is formed by embossing the web longitudinally. In this embodiment imprinting is done directly on one side of the elongate web after which it is severed into lengths substantially twice that of the writing instrument, the embossing being done either simultaneously with or after the imprinting step, followed by positioning a pen assembly in a channel 15, and folding the web to envelop the cartridge with the channel 15 in the upper portion of the folded web coming into registry with the channel 15 in the lower portion of the web, as illustrated in FIG. 5.

Figure 3:
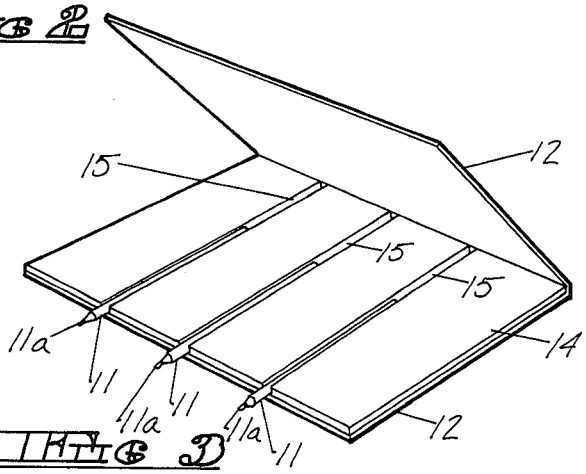
FIG. 3 is a schematic view showing a step in the making of writing instruments by the method of the invention.
Figure 4:
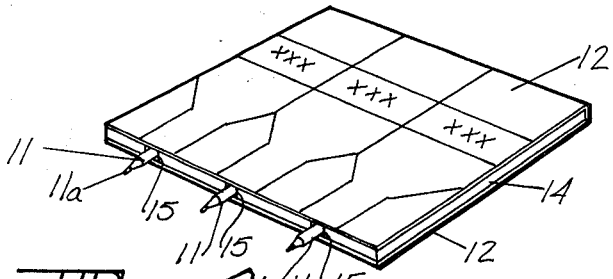
FIG. 4 is a schematic illustration of a further step in the making of writing instruments by the method of the invention.

Referring next to FIGS. 3 and 4, a method of making a writing instrument of the type embodied in FIGS. 1 and 2 is shown somewhat schematically. In the preferred practice a web 12 having a pressure sensitive adhesive on one surface thereof is imprinted on the non-adhesive surface and severed into lengths substantially twice that of the finished writing instrument. Strips 14 of paperboard, foamed resin and the like are positioned in parallel, spaced-apart relation as shown in FIG. 3, with spacing therebetween suitable to provide an elongated channel 15 which will accommodate an elongated cylindrical ink cartridge 11. By way of an exemplary showing, FIG. 3 illustrates an imprinted web of sufficient width to accommodate three cartridges 11 with strips 14 therebetween, which will be die-cut subsequently into three writing instruments.

The strips 14 are adhered to the lower web portion 12 in conventional manner and the cartridges 11 are then placed in proper position in the channels 15 with writing tips 11*a* projecting therefrom a fraction of an inch. In this connection, it will be understood that it is not necessary to provide for retraction or covering of the writing tips since the ink cartridge does not dry out over extended periods of storage.

Referring to FIG. 4, the next step of the method is shown, which involves folding the upper web portion downwardly in sandwich relation to the strips 14 and cartridges. The upper web portion is adhesively secured to strips 14, and the cartridges are adhesively secured between upper and lower web portions 12. In this connection, it will be understood that the web 12 may either be provided with a pressure-sensitive adhesive coating on the inner surface which is not imprinted, or adhesive may be applied to the strips 14 or to the upper and lower web portions 12 just prior to folding them into opposed relation.

The method described above is generally applicable to the embodiment of FIG. 5, the only difference being that adhesive is provided on the opposed inner surfaces of the embossed web 12 when the web comprises paperboard, foamed resin, or the like having a thickness of about ½ to 2 mm.

Figure 6:
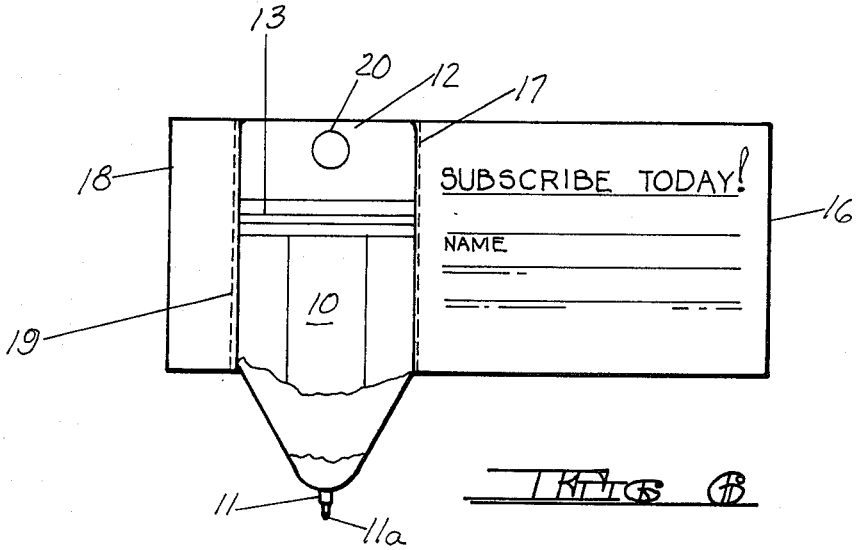
FIG. 6 is an elevational view of another embodiment of a writing instrument of the invention.

Reference is next made to the embodiment of FIG. 6 wherein various optional features are illustrated. In this embodiment the writing instrument is imprinted and die-cut in such a manner as to simulate a short lead pencil having the writing tip 11*a* projecting from the pointed end thereof. In applications where the writing instrument is to be secured in some manner to the page of a magazine or other publication, or included in a mailing piece with a detachable coupon, order form or the like incorporated, as shown at 16, a line for severance 17 is provided for convenient detachment of the coupon 16. On the opposite side a tab 18 may also be provided for binding or spot-gluing onto the page of a publication, with a line for severance 19 which permits convenient detachment of the writing instrument.

If the writing instrument is to be sold in a retail store, a hole 20 may be provided by die-cutting adjacent the end thereof remote from the writing tip permitting the instruments to be hung on display racks in conventional manner adjacent a point-of-purchase location in a store.

It will be understood that the printing, embossing die-cutting and related apparatus used in the manufacture of the writing instrument of the invention are conventional and form no part of the present invention. For this reason such apparatus is not illustrated in the drawings.

It will be evident from the above descriptions that the writing instrument can be made from inexpensive materials in a wide variety of configurations which will permit maximum exposure of flat surfaces to imprinting of various types. Since its thickness ranges from about 1 to about 4 mm, the writing instrument can be conveniently carried in a wallet, check-book, pocketbook or the like, or may be used as bookmark. Moreover, the writing instrument can be readily bound into magazines or other publications, or can be attached to score cards, sports programs and the like for ready detachment along a line for severance. The method of manufacture is simple and economical, primarily by reason of the fact that imprinting on one side only of a web is involved, followed by severance of the web and folding thereof into a sandwich-type structure which envelops the ballpoint pen assembly.

Modifications may be made without departing from the scope of the invention. For example, while it has been indicated above that the writing tip is exposed in the finished product, where some protection or covering of the writing tip is considered desirable, a small section of adhesive-backed web may be left enveloping the writing tip, with lines for severance permitting such pieces to be detached prior to use.

I claim:

1. A writing instrument comprising a ballpoint pen assembly having a writing tip and an elongated cylindrical ink cartridge, a holder for said assembly having two substantially flat outer surfaces secured in opposed parallel spaced relationship, the spacing of said outer surfaces being such that the thickness of said holder ranges from about 1 to about 4 mm, and a web having an elongated channel enclosed between said outer surfaces in which said cartridge is secured with said writing tip projecting outwardly from said holder, said outer surfaces and said web having a width at least about ten times the thickness of said holder and a length exceeding that of said pen assembly, both said flat outer surfaces having imprinted indicia and the like thereon.

2. The writing instrument claimed in claim 1, wherein said outer surfaces are adhesive-backed paper, and wherein said web comprises spaced-apart strips of paperboard having a thickness of about 1 to about 4 mm secured between said outer surfaces, said elongated channel being provided between said spaced-apart strips.

3. The writing instrument claimed in claim 1, wherein a hole is provided adjacent one end of said holder remote from said writing tip.

4. The writing instrument claimed in claim 1, including at least one line for severance along at least one side of said holder defining an area readily detachable from said holder by tearing along said line.

5. The writing instrument claimed in claim 1, wherein said outer surfaces are adhesive-backed plastic film, and wherein said web comprises spaced-apart strips of foamed resin having a thickness of about 1 to about 4 mm secured between said outer surfaces, said elongated channel being provided between said spaced-apart strips.

6. The writing instrument claimed in claim 1, wherein said outer surfaces are adhesive-backed foil, and wherein said web comprises spaced-apart strips of wood having a thickness of about 1 to about 4 mm secured between said outer surfaces, said elongated channel being provided between said spaced-apart strips.

7. A writing instrument comprising a ballpoint pen assembly having a writing tip and an elongated cylindrical ink cartridge, a holder for said assembly having two substantially flat outer surfaces in opposed parallel spaced relation, the spacing of said outer surfaces being such that the thickness of said holder ranges from about 1 to about 4 mm, said holder being comprised of a pair of adhesively secured webs, and an elongated channel in said webs enclosed between said outer surfaces in which said cartridge is secured with said writing tip projecting outwardly from said holder, said webs having a width at least about ten times the thickness of said holder and a length exceeding that of said pen assembly, both said flat outer surfaces having imprinted indicia and the like thereon.

8. The writing instrument claimed in claim 7, wherein each said web is adhesive-backed paperboard, and wherein said elongated channel is embossed therein.

9. The writing instrument claimed in claim 7, wherein each said web is adhesive-backed foamed resin, and wherein said elongated channel is embossed therein.

* * * * *